US006615838B1

(12) United States Patent
Tsai

(10) Patent No.: US 6,615,838 B1
(45) Date of Patent: Sep. 9, 2003

(54) MASK

(76) Inventor: De-Sheng Tsai, No. 140, Pao-An Street, Tai-Nan City (TW)

( * ) Notice: Subject to any disclaimer, the term of this patent is extended or adjusted under 35 U.S.C. 154(b) by 0 days.

(21) Appl. No.: 10/170,555

(22) Filed: Jun. 14, 2002

(51) Int. Cl.[7] ..... A61F 11/00
(52) U.S. Cl. ..... 128/857
(58) Field of Search ..... 128/846, 848, 128/857, 858, 859, 206.13, 206.19; 2/9

(56) References Cited

U.S. PATENT DOCUMENTS 2,171,311 A * 8/1939 Moses
2,458,580 A * 1/1949 Fisketti
2,667,869 A * 2/1954 D'Elia
5,717,991 A * 2/1998 Nozaki et al. ..... 206/13
6,409,746 B1 * 6/2002 Igaki et al. ..... 607/109

FOREIGN PATENT DOCUMENTS

TW 234338 11/1994 ..... A62B/9/06

* cited by examiner

*Primary Examiner*—Michael A. Brown
(74) *Attorney, Agent, or Firm*—Bacon & Thomas, PLLC

(57) ABSTRACT

A mask is made of a single piece of flexible, elastically deformable fabric trimmed to be substantially symmetric. The mask includes two flaps connected to each other along a center folding line. A V-shaped cutoff is formed above and below the center folding line between the flaps. The single piece of fabric is bent along the folding line with the flaps overlapping each other. Side edges of the flaps that define each V-shaped cutoff are sealed together by means of sewing or adhesives whereby an interior space is formed between the flaps and defined by the center folding line and the sealed side edges of the V-shaped cutoffs for comfortably accommodating the nose and mouth of a wearer.

5 Claims, 2 Drawing Sheets

MASK

FIELD OF THE INVENTION

The present invention relates generally to a mask that covers the nose and mouth of a wearer, and in particular to a one-piece mask forming a space for comfortably accommodating the noise and mouth of the wearer.

BACKGROUND OF THE INVENTION

Masks have been widely used to cover a wearer's mouth and nose in order to prevent inhalation of contamination particles and bacteria and, to avoid transmission of diseases. Some of the masks of this purpose comprise multiple layers of gauzes and/or other materials made in the form of a flexible flat strip having a sufficient surface for covering the mouth and nose of a wearer. Two ear bands are attached to opposite ends of the strip for attaching the mask to the wearer's face.

The conventional masks are made as a flat piece. Although the masks are flexible, they can be only compliant to the contour of the wearer's face to some extents. They cannot be in complete compliance with the wear's face contour. Gaps are thus formed between the mask and the wearer's face and contamination particles may be inhaled by the wearer through the gaps. Undesired strains may also be caused on the wearer's face, making the wearer uncomfortable. In addition, the activity of the wearer's face muscles in for example speaking and laughing may drive the mask off the wearer's face. Further, make-up of female wearers may be smashed up by the improper contact between the mask and the wearer's face.

Taiwan Patent Publication No. 234338 discloses a mask comprising two separate flaps. The flaps are stacked together and sealed along an edge to connect the flaps together. Such a structure, although being more compliant to the wearer's face, requires a complicated manufacturing process and thus high costs.

Thus, it is desired to have an improvement of the mask for alleviating the problems discussed above.

SUMMARY OF THE INVENTION

An object of the present invention is to provide a mask having a simple structure and thus low manufacturing costs.

Another object of the present invention is to provide a mask that is in compliance with a wearer's face contour.

A further object of the present invention is to provide a mask forming a space for comfortably accommodating the nose and mouth of a wearer.

To achieve the above objects, in accordance with the present invention, there is provided a mask that is made of a single piece of flexible, elastically deformable fabric trimmed to be substantially symmetric, comprising two flaps connected to each other along a center folding line. A V-shaped cutoff is formed above and below the center folding line between the flaps. The single piece of fabric is bent along the folding line with the flaps overlapping each other. Side edges of the flaps that define each V-shaped cutoff are sealed together by means of sewing or adhesives whereby an interior space is formed between the flaps and defined by the center folding line and the sealed side edges of the V-shaped-cutoffs for comfortably accommodating the nose and mouth of a wearer.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE INVENTION

Figure 1:
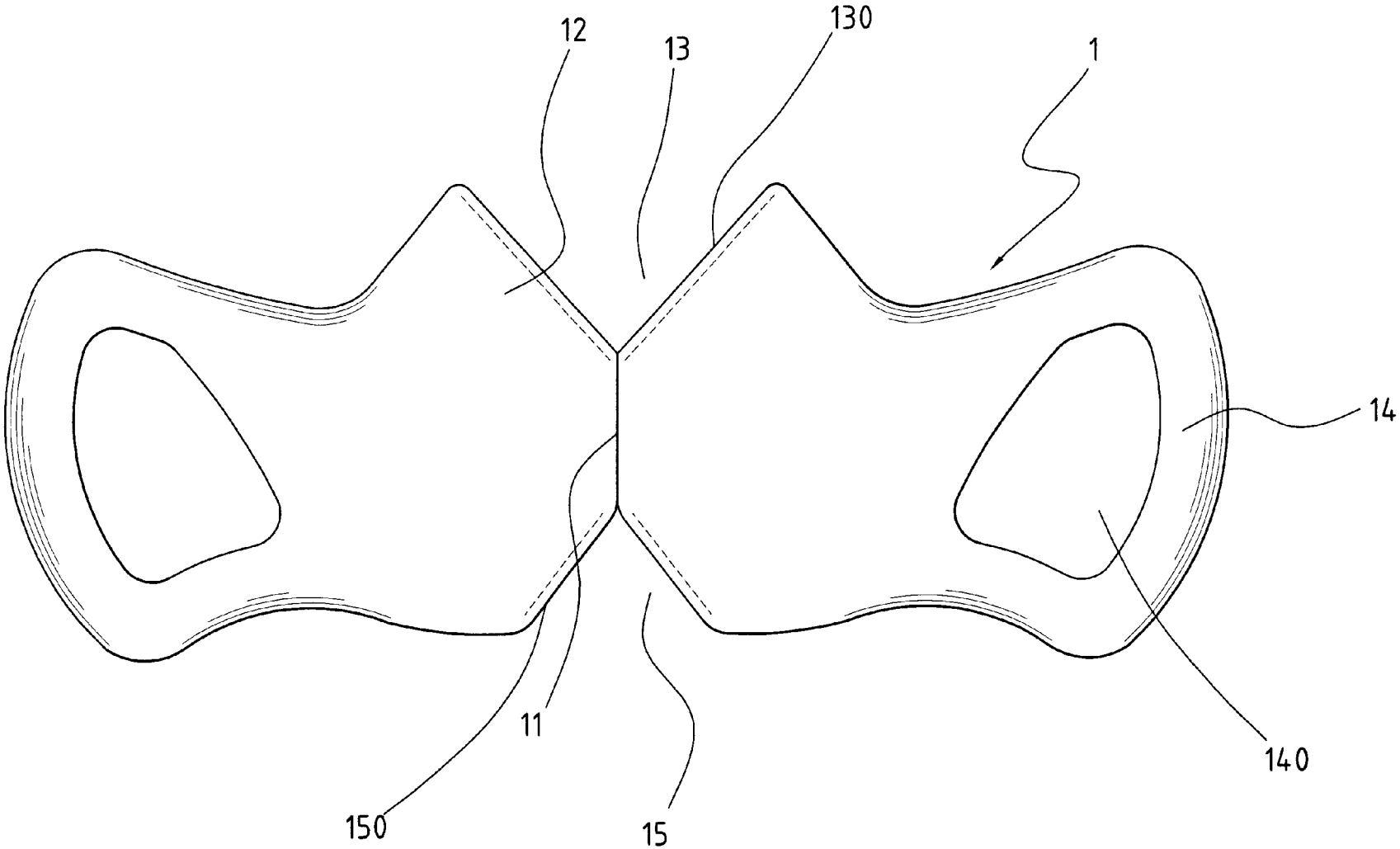
FIG. 1 is a plan view of a mask constructed in accordance with the present invention.

With reference to the drawings and in particular to FIG. 1, a mask constructed in accordance with the present invention comprises a single piece of flexible fabric processed (for example trimming) to form a symmetric configuration, generally designated with reference numeral 1. Preferably, the material that makes the mask 1 is elastically deformable. The mask 1 has two identical flaps 12 arranged on opposite sides and symmetric about a center folding line 11. A V-shaped cutoff 13, 15 is formed above and below the center folding line 11, each being defined by opposite sides flanges 130, 150 of the flaps 12. Each flap 12 of the mask 1 is formed with an opening 140 by means of punching whereby an ear strip 14 is formed on a remote edge of the flap 12 for engaging an ear of a wearer (not shown) to attach the mask 1 to the wearer's face.

Figure 2:
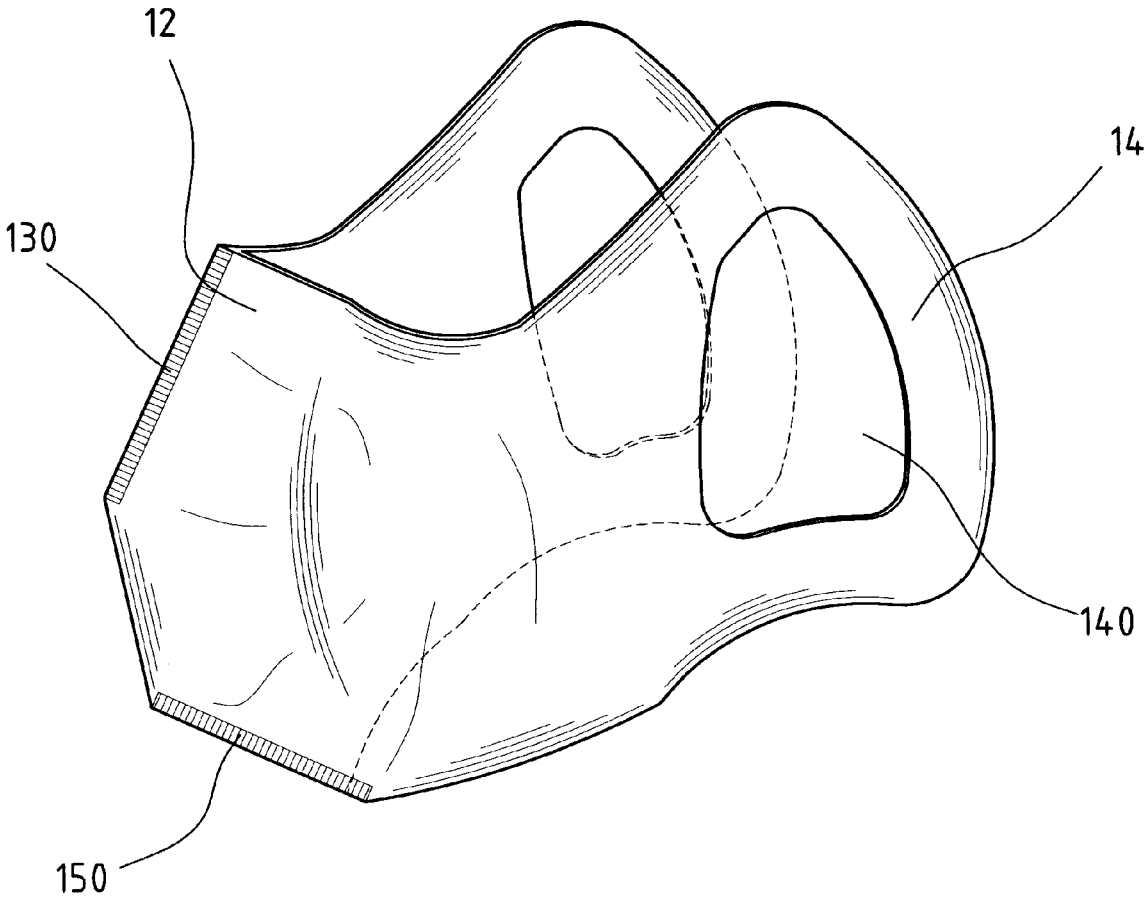
FIG. 2 is a perspective view of the mask of the present invention.

Also referring to FIG. 2, the piece of flexible fabric of the mask 1 is bent along the folding line 11 to have the flaps 12 overlapping each other. The side flanges 130, 150 of each V-shaped cutoff 13, 15 overlap each other and are sealed together by means of sewing or adhesives whereby an interior space (not labeled) is formed between the flaps 12 and defined by the folding line 11 and sealed flanges 130, 150 for accommodation of the nose and mouth of the wearer. This allows the mask 1 to be compliant with the contour of the wearer's face and thus gaps between the conventional mask and the wear's face can be effectively reduced.

The elasticity of the material that makes the mask 1 makes it easy to have the mask 1 compliant with the face contours of different wearers.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A mask comprising a single piece of elastically deformable material, having first and second flaps overlapping and connected to each other along a center folding line, a V-shaped cutoff being formed above and below the center folding line between the flaps and defined by side flanges of the flaps, the side flanges being sealed together whereby an interior space is formed between the flaps for accommodating the nose and mouth of a wearer.

2. The mask as claimed in claim 1, wherein the side flanges are sealed by means of sewing.

3. The mask as claimed in claim 1, wherein the side flanges are sealed by means of adhesives.

4. The mask as claimed in claim 1, wherein an opening is defined in each flap to form an ear strip for engaging an ear of the wearer and attaching the mask to the wearer's face.

5. The mask as claimed in claim 1, wherein the elastically deformable material comprises a flexible fabric.

* * * * *